United States Patent [19]

Besson et al.

[11] 4,232,464

[45] Nov. 11, 1980

[54] METHOD FOR THE DISPLAY OF INFORMATION

[75] Inventors: René Besson, Neuchatel; Jean-Luc Breguet, La Chaux-de-Fonds, both of Switzerland

[73] Assignee: Ebauches S.A., Neuchatel, Switzerland

[21] Appl. No.: 877,854

[22] Filed: Feb. 15, 1978

[30] Foreign Application Priority Data

Feb. 18, 1977 [CH] Switzerland ..... 2039/77

[51] Int. Cl.[3] ..... G09F 9/35

[52] U.S. Cl. ..... 40/451

[58] Field of Search ..... 40/447, 448, 450, 451, 40/107; 340/752; 350/160 LC

[56] References Cited

U.S. PATENT DOCUMENTS

| | | | |
|---|---|---|---|
| 542,928 | 7/1896 | Crandall | 40/452 |
| 671,538 | 4/1901 | Conti | 40/452 |
| 1,906,960 | 5/1933 | Harris | 40/452 |
| 2,268,441 | 12/1941 | Boswau | 40/452 |
| 3,925,977 | 12/1975 | Maezawa | 340/756 |
| 4,017,155 | 4/1977 | Yagi et al. | 40/451 |
| 4,040,193 | 8/1977 | Matsuda | 40/451 |
| 4,079,367 | 3/1978 | Yonezawa | 340/756 |
| 4,122,444 | 10/1978 | Kitajima | 40/451 |

*Primary Examiner*—Louis G. Mancene
*Assistant Examiner*—Wenceslao J. Contreras
*Attorney, Agent, or Firm*—Silverman, Cass & Singer, Ltd.

[57] ABSTRACT

A method for the display of information by means of a multi-element passive display device, the elements being separately activated, matrixially arranged and at least two elements required to be activated for display of information. The type of display involves use of a liquid crystal cell formed of electrodes and counter-electrodes carried by two glass plates respectively and the said elements are parts of said electrodes and counter-electrodes.

The method comprises the election for activation of elements which are adjacent in any direction, that is, either those superposed, or side by side or diagonally arranged. This method enables use of conventionally shaped characters of greater individual size than heretofore available and is useful for display of dates and/or days of the week on electro-optic watches.

4 Claims, 8 Drawing Figures

METHOD FOR THE DISPLAY OF INFORMATION

This invention relates generally to electro-optic display devices of the type comprising several matrixially arranged, separately activatable elements, at least two of said elements required to be activated for display of information, such as the dates and days of the week.

More particularly, this invention provides a method for display of such information by activating said elements which are adjacent in any direction whereby materially to enable increase in the size of the representative characters while using conventional character configurations.

Two types of watches are known, which are provided with a device enabling the display the dates and the days of the week. Two types of such watches exist. In the first type, the display is effected by means of digits, each digit enabling the display a numeral or a letter. Thus, the display of the day or of the date requires two digits. In the other type, all the possible information, for instance 31 items where display of the dates is desired, are distributed on the display zone, such as a cell. The indication is obtained by masking the non-used information or by activating the information corresponding to that which has to be displayed. The first type of display does not require much space while enabling the use of information of relatively great dimension. However, it is disadvantageous to use the first type of display where numerals or letters have an unconventional configuration which is similar to the configurations of the numerals serving to display time.

The second type of display enables the use of any character configuration but requires very small character size, often too small to facilitate reading thereof.

SUMMARY OF THE INVENTION

The method according to the invention is characterized by the fact that one displays the said information while activating elements which are adjacent in any direction.

DESCRIPTION OF PREFERRED EMBODIMENTS

Figure 1:
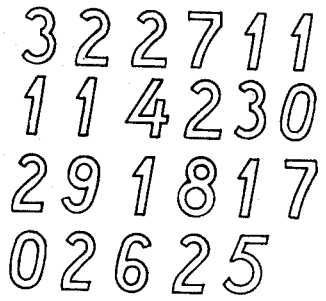
FIG. 1 represents a table permitting the display of the 31 dates of the month.

The table represented in FIG. 1 enables display of the 31 dates of the month using 23 numerals, in contrast to the employment of a conventional arrangement where all the dates of the month are printed on the display table, requiring use of 53 numerals. Thus for the same occupation of space, the surface occupied by each of the numerals can be more than doubled. In the arrangement of FIG. 1, the date is displayed by means of two adjacent numerals, the representative electrodes and counter-electrodes of which are activated simultaneously. These numerals are located one beside the other or one above the other, and the reading is effected from left to right or from the top to the bottom, respectively. One also could obtain the display by activating numerals adjacent in the diagonal direction.

Figure 2:
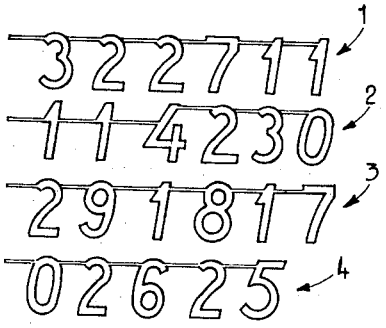
FIG. 2 shows the electrodes and FIG. 3 the counter-electrodes of a passive electro-optic display cell enabling the display of the information of the table represented in FIG. 1.
Figure 3:
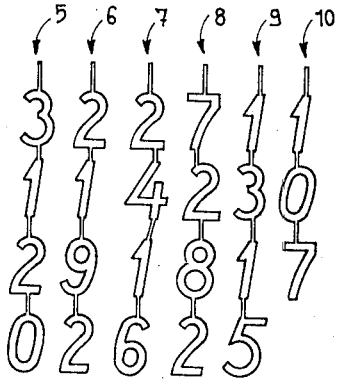

The type of display illustrated in FIG. 1 can be used with a cell with liquid crystals. In this case, the cell is constituted of two plates of glass carrying respectively electrodes and counter-electrodes. The four electrodes represented in FIG. 2 are designated by reference characters 1 to 4, while the six counter-electrodes represented in FIG. 3 are designated by reference characters 5 to 10.

The display of the several dates of the month can be represented by the following table:

| | Electrodes | | | | Counter-electrodes | | | | | |
|---|---|---|---|---|---|---|---|---|---|---|
| Dates | 1 | 2 | 3 | 4 | 5 | 6 | 7 | 8 | 9 | 10 |
| 1 | | x | | | x | | | | | |
| 2 | x | | | | | x | | | | |
| 3 | x | | | | x | | | | | |
| 4 | | x | | | | | x | | | |
| 5 | | | | x | | | | | x | |
| 6 | x | | | x | | | x | | | |
| 7 | | | x | | | | | | | x |
| 8 | | | x | | | | | x | | |
| 9 | | | x | | x | | | | | |
| 10 | x | x | | | | | | | | x |
| 11 | x | | | | | | | | x | x |
| 12 | | x | x | | x | | | | | |
| 13 | x | x | | | | | | | x | |
| 14 | | x | | | | x | x | | | |
| 15 | | | x | x | | | | | x | |
| 16 | | | x | x | | | x | | | |
| 17 | | | x | | | | | | x | x |
| 18 | | | x | | | | x | x | | |
| 19 | | x | x | | | x | | | | |
| 20 | | | x | x | x | | | | | |
| 21 | x | x | | | | x | | | | |
| 22 | x | | | | | x | x | | | |
| 23 | | x | | | | | | x | x | |
| 24 | x | x | | | | | x | | | |
| 25 | | | | x | | | | x | x | |
| 26 | | | | x | | x | x | | | |
| 27 | x | | | | | | x | x | | |
| 28 | | x | x | | | | | x | | |
| 29 | | | x | | x | x | | | | |
| 30 | | x | | | | | | | x | x |
| 31 | | x | x | | | | | | x | |

The first column of the table carries the indication of the dates of the month, numbered with 1 to 31. The central column corresponds to the electrodes, the ones which have to be activated being noted with "x"; the right hand column corresponds to the counter-electrodes, the representation being the same as for the electrodes.

Figure 4:
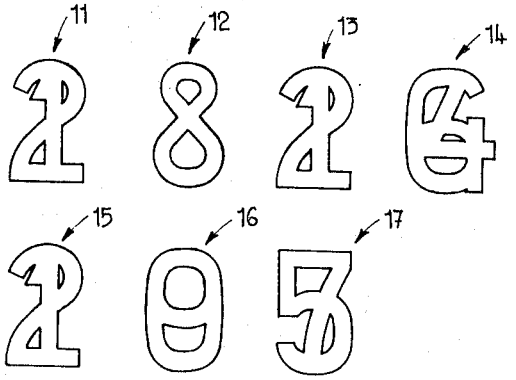
FIG. 4 represents a second embodiment of a display device enabling the display of the several dates of the month.
Figure 5:
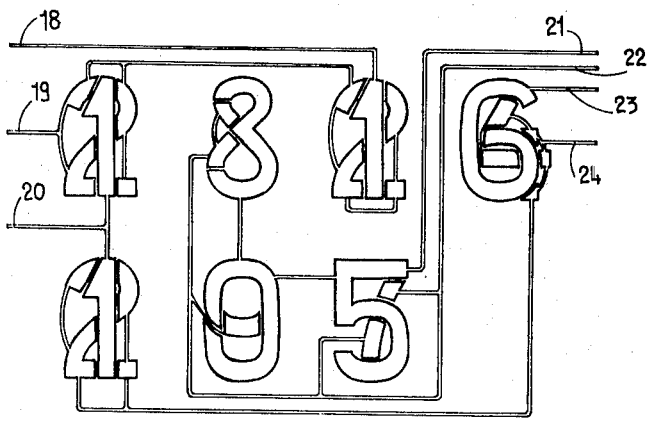
FIG. 5 represents the electrodes and FIG. 6 the counter-electrodes of a cell enabling the display the informatin of the device of FIG. 4.
Figure 6:
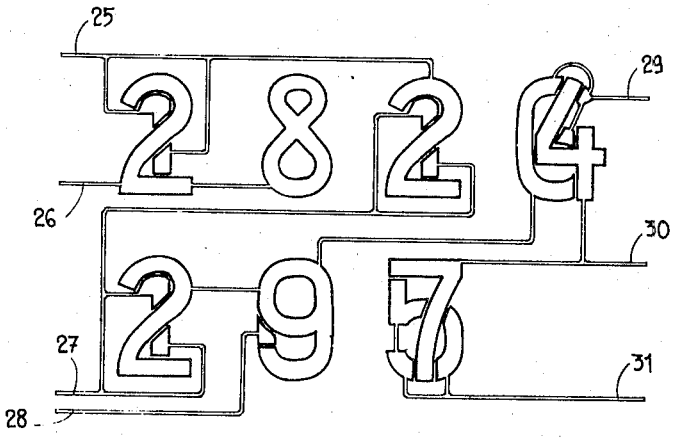

The second embodiment as represented in FIGS. 4, 5 and 6, needs only seven groups or sets of composite configurations represented by reference characters 11 to 17 for the display of the 31 dates of the month. Each group enables the display a pair of numerals the configurations of which are superposed. Thus, the groups designated 11, 13 and 15 enable the display of the numberals "1" and "2", the group 12 enabling the display of the numerals "3" and "8", the group 14 enabling the display of the numerals "4" and "6", the group 16 enabling the display of the numerals "O" and "9" and the group 17 enabling the display of the numberals "5" and "7". The display of numbers comprising more than one numeral is obtained by activating adjacent configurations 11 to 17, situated one beside the other or one above the other.

the control of this device is effected by means of seven electrodes (FIG. 5) represented by reference characters 18 to 24 and of seven counter-electrodes (FIG. 6) represented by reference characters 25 to 31.

The display of the several dates of the month can be represented by the following table:

| | Electrodes | | | | | | | Counter-electrodes | | | | | | |
|---|---|---|---|---|---|---|---|---|---|---|---|---|---|---|
| Dates | 18 | 19 | 20 | 21 | 22 | 23 | 24 | 25 | 26 | 27 | 28 | 29 | 30 | 31 |
| 1 | | | x | | | | | x | x | | | | | |
| 2 | | | x | | | | x | | | | | x | | |
| 3 | | | | x | | | | | x | | | | | |
| 4 | | | | | | x | x | | | | | | x | |
| 5 | | | | x | | | | | | | | | x | x |
| 6 | | | | | | x | | | | | | x | x | |
| 7 | | | | x | x | | | | | | | | x | |
| 8 | | | | x | x | | | | x | | | | | |
| 9 | | | | x | x | | | | | | | x | | |
| 10 | | | x | x | | | | | | x | x | x | | |
| 11 | | | x | | | | | x | x | x | | x | | |
| 12 | | | x | | | | x | x | x | | | x | | |
| 13 | | | x | x | | | | x | x | | | | | |
| 14 | x | | | | | x | x | x | | x | | | x | |
| 15 | x | | | x | | | | x | | x | | | x | x |
| 16 | x | | | | | x | | x | | x | | x | x | |
| 17 | x | | | x | x | | | x | | x | | | x | |
| 18 | | | x | x | x | | | x | x | | | | | |
| 19 | | | x | x | x | | | | | x | | x | | |
| 20 | | | x | x | | | x | | | | x | x | | |
| 21 | | x | x | | | | | | x | x | | x | | |
| 22 | | x | x | | | | x | | x | | | x | | |
| 23 | | x | x | x | | | | | x | | | | | |
| 24 | x | x | | | | x | x | x | | | | | x | |
| 25 | x | x | | x | | | | x | | | | | x | x |
| 26 | x | x | | | | x | | x | | | | x | x | |
| 27 | x | x | | x | x | | | x | | | | | x | |
| 28 | | x | x | x | x | | | | x | | | | | |
| 29 | | | x | x | x | | x | | | | | x | | |
| 30 | | | | x | | | | | x | | x | x | | |
| 31 | x | | | x | | | | x | x | x | | | | |

The first column corresponds to the dates of the month. The central column indicates those electrodes which are activated for each date, indicated by "x", while the right hand column corresponds to the counter-electrodes which are activated for said purpose. This arrangement, in spite of the fact that it requires use of more electrodes than the arrangement of FIGS. 1 to 3 previously described, enable the use of numerals of a greater dimension for a same occupied area. Each numeral can occupy a surface about three times greater than occupied by the embodiment of FIGS. 1 to 3, and six times greater than in the known or conventional display where the totality of the information must appear on the display zone.

Figure 7:
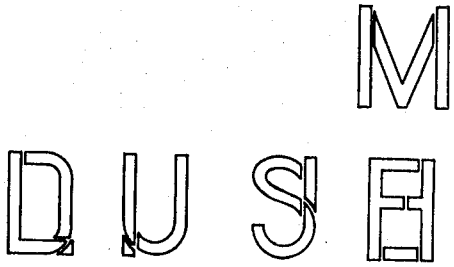
FIG. 7 represents a third embodiment of a display device permitting the display of the days of the week.
Figure 8:
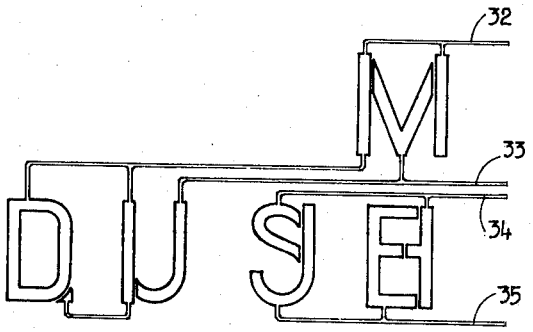
FIG. 8 represents the electrodes and FIG. 9 the counter-electrodes of a cell enabling the selected display of the information illustrated in the device of FIG. 7.
Figure 9:
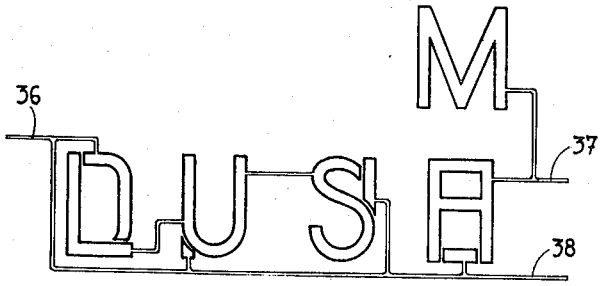

A similar arrangement (FIG. 7) could be used for the display of the days of the week, the control of such device being effected by means of the four electrodes represented by reference characters 32 to 35 of FIG. 8 and of the three counter-electrodes represented by reference characters 36, 37 and 38 of FIG. 9.

For the purposes of description herein, the conventional reading direction in reference to the rectangular formation illustrated in FIGS. 1, 2 and 3 is straight from left to right and top to bottom, as well as diagonally from left to right and top to bottom.

The means used for producing this control will not be disclosed here in detail, since they appear in the U.S. Pat. Application Ser. No. 877,891 filed on Feb. 15, 1978, corresponding to Swiss Pat. Application Ser. No. 1.886/77.

What we claim is:

1. A method for the display of information, especially for watches, using a display device of the type comprising several elements arranged in a rectangular formation, said elements being separately activatable, at least a group of at least two of said elements being required to be activated to effect the said display, said method comprising the steps of: activating a first element; and activating at least one selected element to said first element in one of three directions of reading namely left to right, top to bottom and top to bottom and left to right in a diagonal direction.

2. A method for the display of information in a conventional reading direction, especially for watches, using a display device of the type comprising several elements arranged in a rectangular formation, said elements being separately activatable, at least a group of at least two of said elements being required to be activated to effect said display, said method comprising the steps: of selecting one of the groups of two adjacent elements wherein the selected one group consists respectively of side by side positioned, superposed positioned and diagonally positioned elements pairs, activating those elements which are adjacent in a direction corresponding to a conventional reading direction.

3. The method as claimed in claim 1 in which at least one of the activated members of the selected element pair includes plural elements.

4. The method as claimed in claim 2 in which at least one of the activated members of the selected element pair includes plural elements.

* * * * *